United States Patent [19]

Bunker et al.

[11] Patent Number: 5,061,958

[45] Date of Patent: Oct. 29, 1991

[54] DISPLAY OF USER SELECTABLE PAPER FEED OPTIONS

[75] Inventors: Keith G. Bunker; Robert L. Sklut; David E. Miller, all of Rochester, N.Y.

[73] Assignee: Xerox Corporation, Stamford, Conn.

[21] Appl. No.: 551,390

[22] Filed: Jul. 12, 1990

[51] Int. Cl.[5] ..... G03G 15/00

[52] U.S. Cl. ..... 355/209; 355/309

[58] Field of Search ..... 355/207, 209, 308, 309, 355/311, 313, 314; 271/9

[56] References Cited

U.S. PATENT DOCUMENTS

| | | | |
|---|---|---|---|
| 4,393,375 | 7/1983 | Sugiura et al. | 346/700 |
| 4,725,869 | 2/1988 | Umezawa et al. | 355/24 |
| 4,734,747 | 3/1988 | Okuda et al. | 355/308 |
| 4,763,889 | 8/1988 | Dei et al. | 271/9 |
| 4,804,997 | 3/1989 | Mizude et al. | 355/311 |
| 4,860,049 | 8/1989 | Tashimitsu et al. | 355/218 |

*Primary Examiner*—Joan H. Pendegrass
*Attorney, Agent, or Firm*—Duane C. Basch; Ronald F. Chapuran

[57] ABSTRACT

A reprographic system of the type having a set of features available for use in executing a copying job, including the ability to pre-select a subset of desired features from the set of all available features for the generation of the copies. The system also includes a user interface suitable for displaying the available features as icons and the ability to execute the copying job in accordance with the pre-selected set of desired features. The system further includes a job status screen, displayed on the user interface, indicating the system status during execution of the copying job. Also displayed on the user interface is a second subset of the available features which represents only those features whose settings may be altered during execution of the copying job, thereby enabling an operator to alter one or more of the second subset during execution of the copying job.

10 Claims, 7 Drawing Sheets

DISPLAY OF USER SELECTABLE PAPER FEED OPTIONS

BACKGROUND OF THE INVENTION

1. Field of the Invention

This invention relates to the selection of paper feed trays in a xerographic printing machine, and in particular to the means for dynamically selecting the tray to be used for sheet feeding.

2. Description of the Prior Art

It is a generally known and desirable practice to automatically switch between paper input trays while running a printing job on a xerographic printing machine. This technique allows the operator to utilize two or more paper supply trays, thereby enabling the filling of one tray while feeding sheets from the other tray. Automatically feeding from a second paper tray, upon detecting that a first tray is empty, results in more efficient use of the printing machine resources.

U.S. Pat. No. 4,804,997 to Mizude et al. discloses a specific cassette selection apparatus having a plurality of removable paper feed cassettes. The apparatus includes an identification device, a specific copying mode selection device, and a paper feeding cassette selection device. The cassette selection device responds to paper-size identification signals and a copying mode selection signal to select a cassette for use in the selected copying mode. The apparatus has three paper feed cassettes and a display means which indicates the proper cassette.

U.S. Pat. No. 4,725,869 to Umezawa et al. discloses a display device of a copying machine which in a special mode such as duplex copying, judges whether the paper feed cassette for copying is proper for the mode selected. If so, the cassette is displayed. If not, applicable feed cassettes are displayed successively. The device further displays not only the non-selection of a proper feed cassette, but the type of cassette.

U.S. Pat. No. 4,860,049 to Toshimitsu et al. discloses an image forming apparatus which has three paper feed cassettes and cassette selection keys which are used to select one of the three cassettes.

U.S. Pat. No. 4,734,747 to Okuda et al. discloses a copying machine with a copy paper detection device in which there is provided a means for detecting the amount of copy paper present in a paper storing means and judging whether the amount of copy paper present exceeds the number of copy sheets designated to be copied. The device has a cassette selecting key and a cassette size display for selection of any of three paper feed cassettes.

U.S. Pat. No. 4,393,375 to Sugira et al. discloses a control system for a copying apparatus which minimizes user error and provides a compact control console. An information display member is capable of sequentially displaying an identification of discrete operating features. Control members are capable of inputting signals for a number of different operating features. The specific discrete operating features are automatically displayed after a predetermined set time.

While the references cited above disclose many methods for determining the correct paper tray for use on a printing job, none disclose the ability to automatically switch between an empty tray and a full tray holding the same type of paper stock. It is however, generally known to have an electrophotographic reproduction machine capable of switching between two paper feed trays or cassettes. This type of "autoswitching" feature is found on some high volume regrographic machines available on the market today. However, not currently available on today's reprographic and printing machines are means to control or limit an operator's selection of an alternate paper source during the execution of a copying or printing job. Specifically, the advantage in allowing the operator to manually switch paper trays during job execution results in increased operator flexibility in controlling the copying task. Conversely, the reason for limiting the scope of the alternate selections is so that the operator will not be able to view, and therefore, will be unable to select features that would disrupt the progress of the current copying job. Furthermore, by limiting the display to only features which may be altered during execution of a job, the user interface is simplified and an operator will be less likely to become confused or frustrated by attempting to select features which are unavailable for alteration during job execution.

It is, therefore, an object of the present invention to provide the operator maximum flexibility to alter machine operation in a manner conducive to obtaining the desired output characteristics, while eliminating the possibility of disrupting the execution of the current copying operation. It is another object of the present invention to provide an interface selection for the enablement of an automatic tray switching feature. It is a further object of the present invention to allow an operator to select a subset of the available paper trays to be used as a set of alternate trays which will be used to assure that a continuous supply of paper is available for the execution of a copying or printing job. It is yet another object of the present invention to allow an operator to dynamically alter the tray currently used for paper feeding during the execution of a printing job. It is an additional object of the present invention to limit the set of alternate paper trays available for dynamic selection by an operator to those identified during the programming of the automatic tray switching feature. It is yet another object of the present invention to display the subset of non-selected alternate trays available for dynamic selection, during execution of a printing job, thereby providing an operator with increased flexibility. It is a final object of the present invention to use an interactive video display to select the paper tray to be used for paper feeding, thereby eliminating the need for mechanical switches located on each of the paper supply trays.

Further advantages of the present invention will become apparent as the following description proceeds and the features characterizing the invention will be pointed out with particularity in the claims annexed to and forming a part of this specification.

SUMMARY OF THE INVENTION

A reprographic system of the type having a set of features available for use in executing a copying job, including the ability to preselect a subset of desired features from the set of all available features for the generation of the copies. The system also includes a user interface suitable for displaying the available features as icons and the ability to execute the copying job in accordance with the pre-selected set of desired features. The system further includes a job status screen, displayed on the user interface, indicating the system status during execution of the copying job. Also displayed on the user interface is a second subset of the available features which represents only those features whose settings may be altered during execution of the copying job, thereby enabling an operator to alter one or more of the second subset during execution of the copying job.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
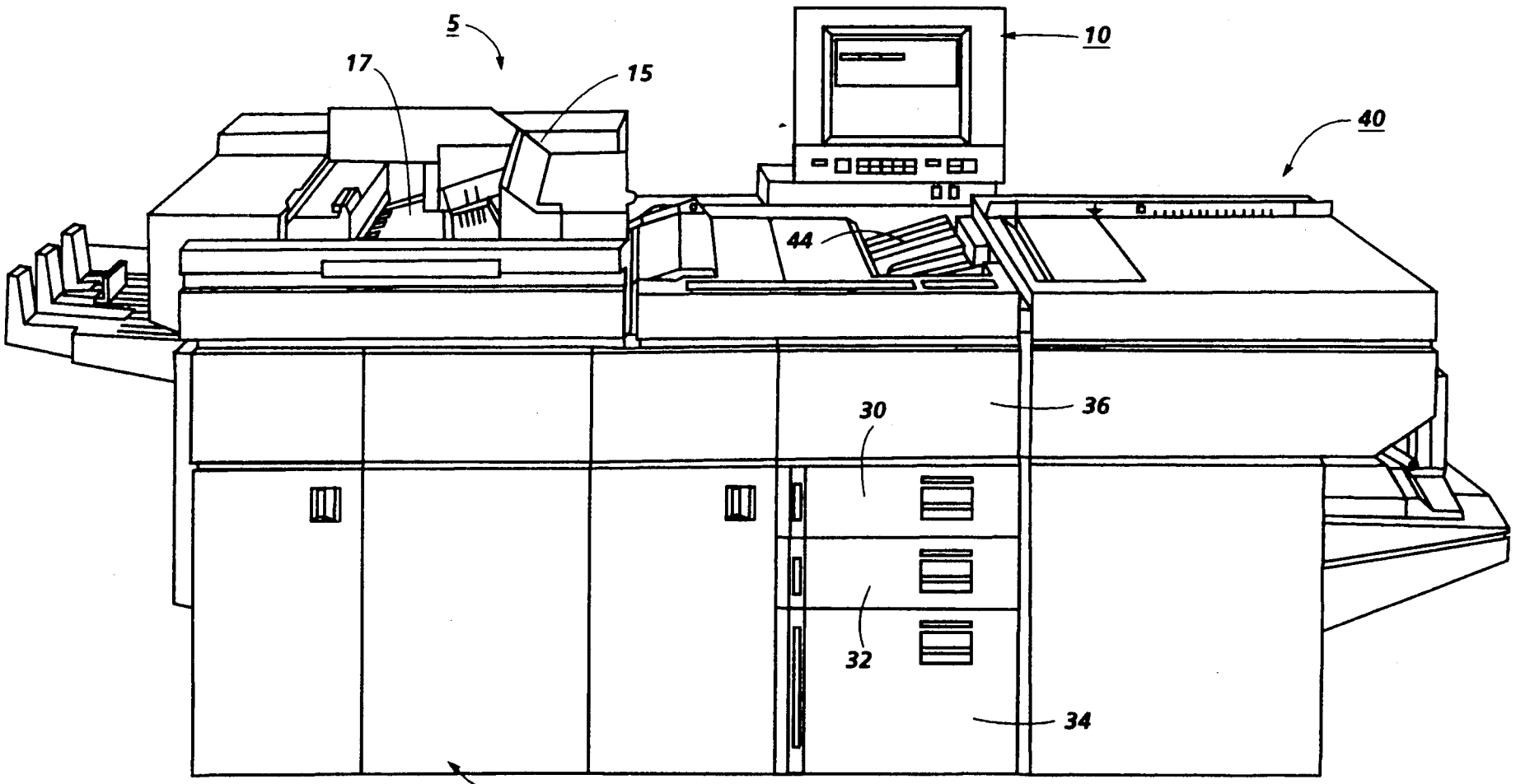
FIG. 1 is an isometric view of an illustrative xerographic reproduction machine incorporating the present invention.

For a general understanding of the features of the present invention, reference is made to the drawings. Referring to FIG. 1, there is shown a typical xerographic reproduction machine 5 composed of a plurality of programmable components and subsystems which cooperate to carry out the copying or printing job programmed through a user interface (U/I)10.

A document handling unit 15 sequentially feeds documents from a stack of documents (not shown) in document tray 17, or optionally from a stack of computer forms, into an imaging position beneath document handling unit 15. Moreover, individual document sheets may be placed manually into the imaging position or fed singularly through document handling unit 15. After imaging, the documents are returned to document tray 17 via simplex or duplex copy paths (not shown) within document handling unit 15. Should the computer form feed (CFF) option be used, output of the computer forms would be to an output stacking tray on the side of the machine. Should an individual document sheet be fed via document handling unit 15, the sheet will be output to a side output tray on the left side of machine 5.

Imaging of the original documents occurs within the xerographic module 20, where the original document, on the platen, is exposed to create a latent image on a photoreceptor (not shown). Subsequently, the latent image is developed and transferred, within xerographic module 20, to a copy sheet which has been fed from one of the copy sheet trays 30, 32 or 34.

Following transfer, the image is permanently affixed to the copy sheet which is subsequently advanced to either finishing module 40, top output tray 44 or to a duplex storage module 36, for the first image on a duplex copy sheet. Options available within finishing module 40 are collation, stapling, and slip sheet insertion from copy sheet trays 30, 32 or 34.

The various functions and features within machine 5 are regulated by a system controller (not shown) which preferably comprises one or more programmable microprocessors. User programming and operating control over machine 5 are accomplished through U/I 10. Generally, operation and control information is stored in system memory (not shown) and accessed by the system controller when necessary. The system controller regulates the operation of the machine based on user programming of desired features, and the system status, as determined by conventional switches and sensors. The features within the machine are then regulated through the control of individual electrical and electromechanical devices, such as conventional servomotors, solenoids, etc.

Figure 2:
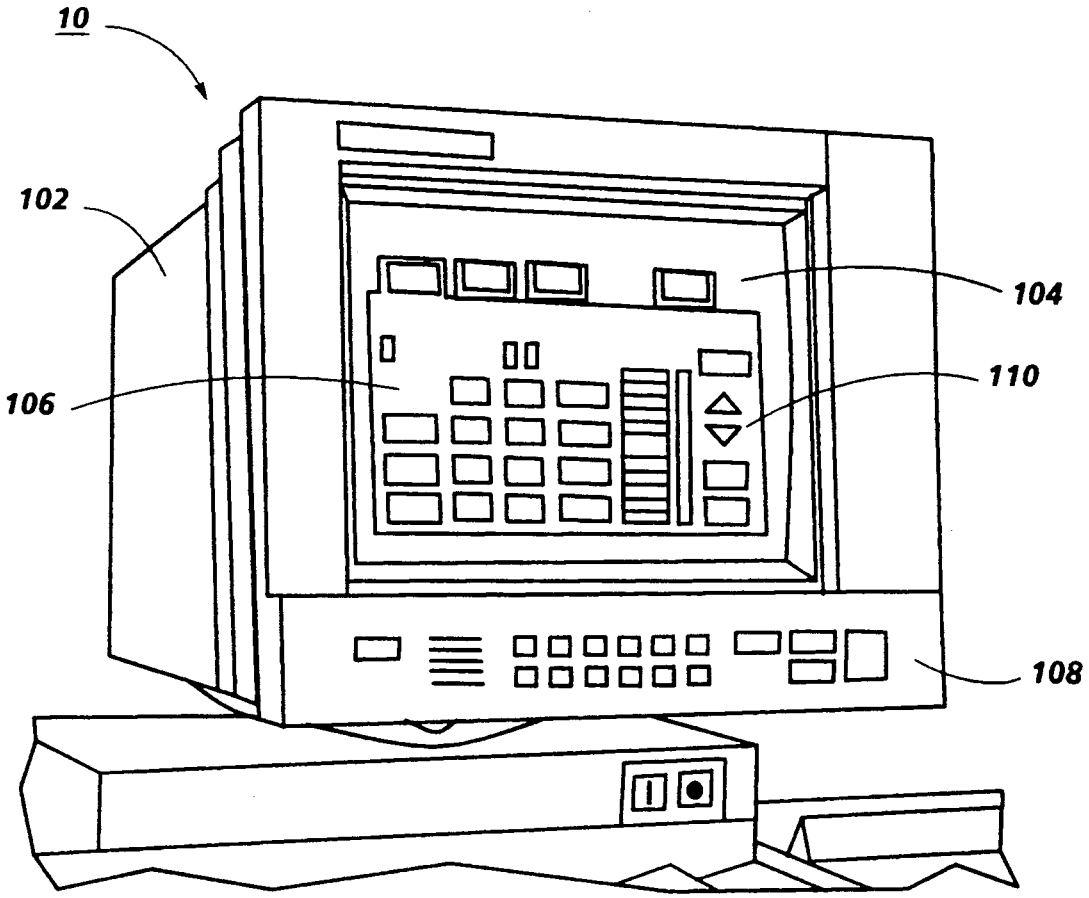
FIG. 2 is an isometric view of an illustrative user interface incorporated in the present invention.

Referring now to FIG. 2, where there is illustrated a detailed representation of U/I 10, which is comprised of U/I housing 102, CRT display 104, Infra-red (IR) touch sensor 106, and keyboard 108. Operator programming of the machine via the U/I is facilitated through display of programming screens 110 on CRT display 104 which represent programming features of the machine. Signals from IR touch sensor 106 are fed to the machine controller where they are interpreted with respect to the current programming screen. Subsequently operator selections are displayed on CRT display 104 and the appropriate machine subsystems are enabled, disabled or adjusted accordingly.

Figure 3:
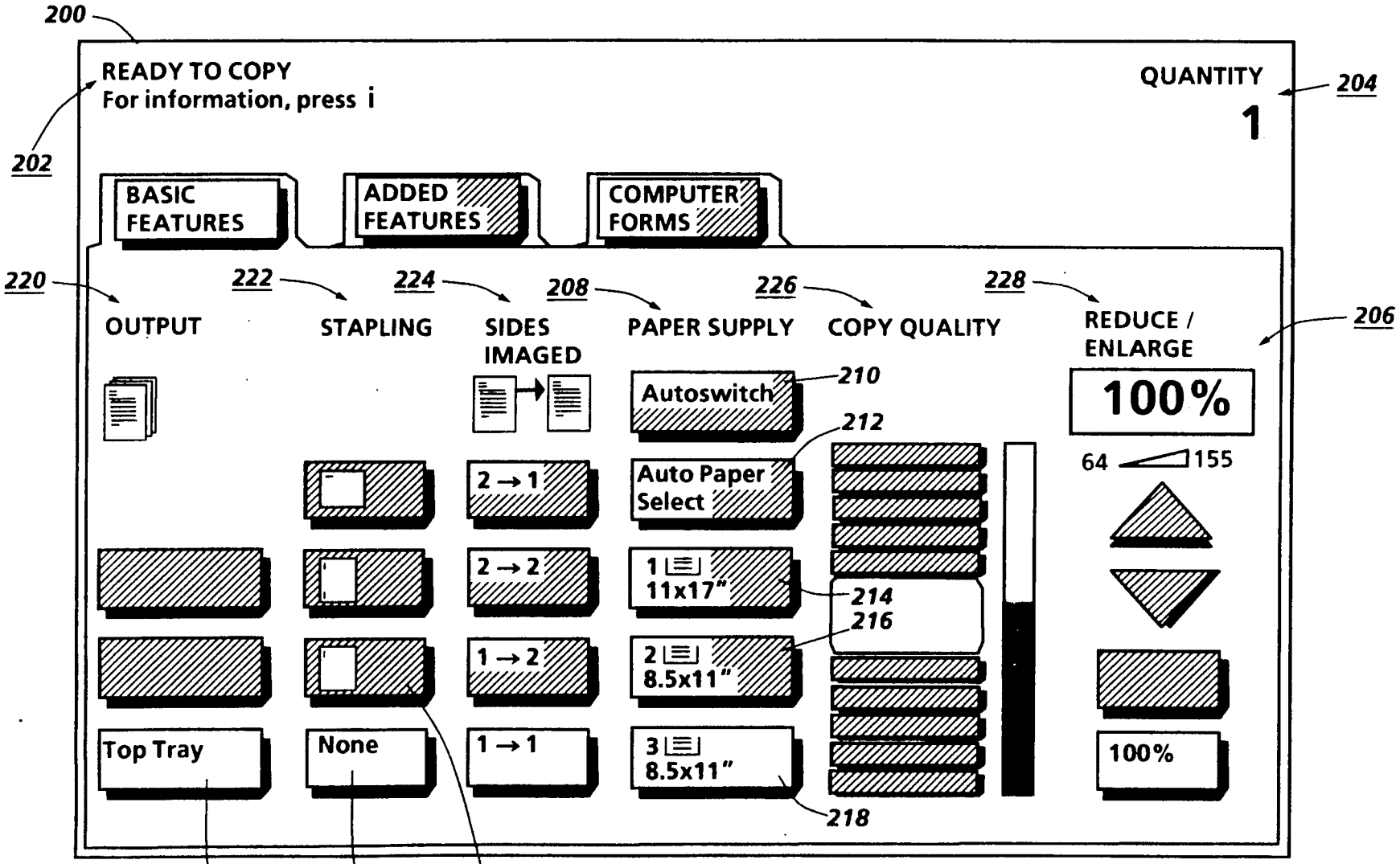
FIG. 3 is an illustration of an operator programming screen displayed on the user interface of FIG. 2.

Programming screens 110, as displayed on CRT display 104, are used by the operator to select the feature set appropriate for the completion of a copying job. Specifically, the programming screens consist of a series of three primary screens (Basic Features, Added Features, Computer Forms), arranged in a file folder or tab format, as illustrated in FIG. 3. The currently programmed feature set is always displayed using programming screens 110, where selected features are indicated as highlighted or white icons and disabled or deselected feature icons are indicated with a neutral or grey background.

With reference to FIG. 3, a basic features operator programming screen, generally referred to by reference numeral 200, is displayed on CRT display 104 of FIG. 2, to allow the operator to select the basic copying features desired to execute a copying job. Generally, programming screen 200 has a status/message area 202, a copy quantity area 204 and a feature programming area 206. Feature programming area 206, includes paper supply selection area 208, which is composed primarily of iconic representations of the paper supply options available to the operator. These iconic representations include; autoswitch icon 210, auto paper select icon 212, first paper tray icon 214, second paper tray icon 216, and third paper tray icon 218. Specifically, each of the paper tray icons, 214, 216, and 218, have represented therein the size of the paper sheets currently loaded in the respective trays, 30, 32, and 34. Furthermore, paper tray icon 218 is illustrated in a highlighted fashion to distinguish it from the remaining unselected trays. Distinguishing the icons within the feature programming area in the highlighted manner identifies those features that have been selected by the operator and are currently enabled.

The feature programming area of the basic features screen 200, also includes output selection area 220, stapling selection area 222, sides imaged selection area 224, copy quality selection area 226, and reduction/enlargement selection area 228. Each of these additional operator programming areas has a set of representative icons, one of which is typically highlighted to indicate the currently selected features.

Figure 4:
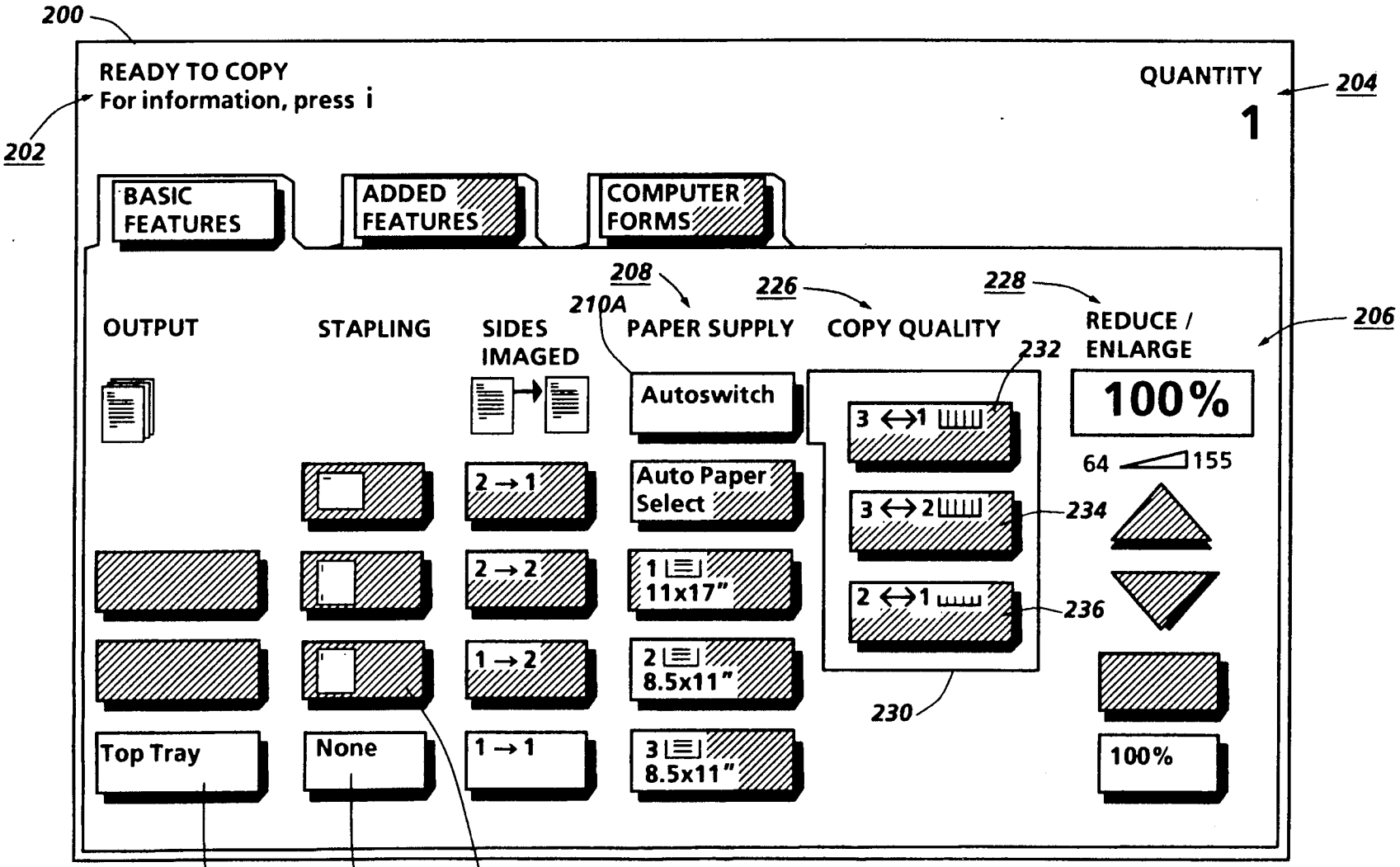
FIG. 4 is another illustration of an operator programming screen displayed on the user interface of FIG. 2.

Referring now to FIG. 4, which also illustrates the basic features operator programming screen 200 of FIG. 3, selection of the autoswitch feature, represented by icon 210 in FIG. 3, results in a highlighted autoswitch icon 210A indicative of the selection having been made. More specifically, selection of the autoswitch icon signals the system controller that the autoswitch feature is desired. The system controller acknowledges selection by highlighting autoswitch icon 210A. In addition, the system controller updates feature programming area 206 of the user interface screen, to indicate the possible tray pair selections for the autoswitch feature within tray pair selection window 230. The intent of the autoswitch option is to enable the system controller, upon determining that an initially selected paper tray is empty, to automatically switch to a backup paper tray, that has been previously selected, to enable the continuation of the copying job. Furthermore, the operator may then add paper to the empty tray, thereby enabling the controller to switch back to that tray when the secondary tray is empty.

Within selection window 230 are the iconic representations of the three possible paper supply tray pairings associated with machine 5, first tray pair icon 232 representing the pairing of paper trays 3 and 1, second tray pair icon 234 representing the pairing of paper trays 3 and 2, and third tray pair icon 236 representing the pairing of paper trays 2 and 1. After selecting the autoswitch feature, icon 210, an operator must indicate which of three possible tray pairings is desired for use in supplying paper during the copying job. For example, selection of the first tray pair icon will signal the system controller that paper tray 3 and paper tray 1 are to be used for completion of the copy job. The system controller will acknowledge the operator's selection by highlighting the selection for example icon 232. Subsequently, selection window 230 will be closed, returning the underlying copy quality selection area display, area 226 of FIG. 3. Also, the tray pair selection will be indicated in the lower portion of autoswitch icon 210A. It should be noted that the present invention, while described herein in relation to the selection of a pair of trays from a total of three possible trays, is extensible to a larger number of trays. Moreover, extension to the selection of trays from a larger set of alternate trays is limited only by the configuration of the reproduction machine and the requirements of the requested copying job. For example, a reproduction machine having four paper supply trays may enable the selection of pairs, triplets or all four trays to be used for the autoswitching operation, subject to the same limitations hereinafter described with respect to the current embodiment.

The system controller, being responsive to signals provided by the length and width guides contained in each tray, identifies any conflicting tray pair selections made by the operator and does not allow the selection of such by the operator. Should the operator select a tray pair icon where the trays have different sizes of paper stock, as indicated in the lower portion of the respective paper tray icons, 214, 216, and 218 of FIG. 3, the system controller will display an error message in status/message area 202. Another example of a conflicting selection would be the selection of two trays containing different types of paper stock, such as, tab stock and transparencies. In these situations, the operator will be instructed to either; select another tray pair icon, place the appropriate paper stock in the trays, or possibly to check the paper tray length and width guides. A third conflicting selection arises when an operator attempts to initiate the copy run without having selected a paper supply tray, for example, the situation illustrated in FIG. 4. In such a situation, the operator would be instructed, via status/message area 202, to make an appropriate tray selection before proceeding. Moreover, it should also be noted that the present invention is extensible to other conflicting feature selections.

Figure 5:
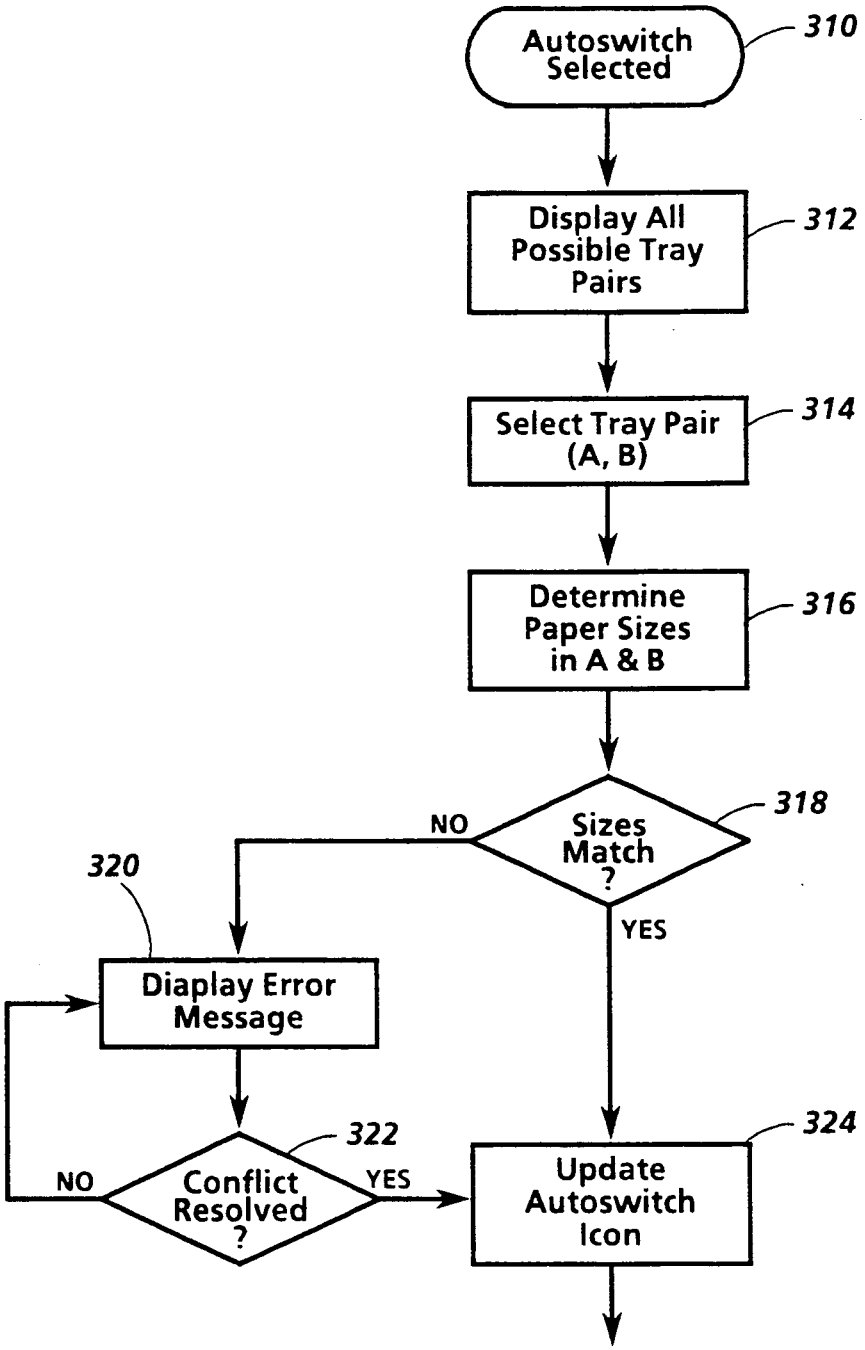
FIG. 5 is a flowchart depicting the procedure used to enable the automatic paper tray switching feature.

Referring also to FIG. 5, which depicts the tray pair selection process in accordance with the present invention, the process is initiated by the selection of autoswitch icon 210 of FIG. 3 as indicated by block 310. Once the autoswitch feature has been selected, the system controller causes the display of all possible tray pairings at block 312, which in turn results in the display of selection area 230. Subsequent operator selection of a tray pair (A,B) at block 314, signals the system controller to determine the size of the paper contained in each tray of the selected pair (A and B), at block 316. After determining the respective paper sizes in trays A and B, the system controller tests to determine if the sizes are the same for both trays, block 318. If a difference in size is detected, an error message is displayed, as described previously, block 320, until the conflict has been resolved or another selection has been made, block 322. If no size difference is detected, or an alternate, non-conflicting selection is made, the autoswitch icon is updated to include the tray pair selection and selection window 230 is closed to redisplay the underlying copy quality selection area, block 324. At the same time that the autoswitch icon is being updated, the system controller saves a 3-bit autoswitch control value indicative of the paper supply trays included in the set of alternate trays, each bit therein representing one of the paper trays.

Figure 6:
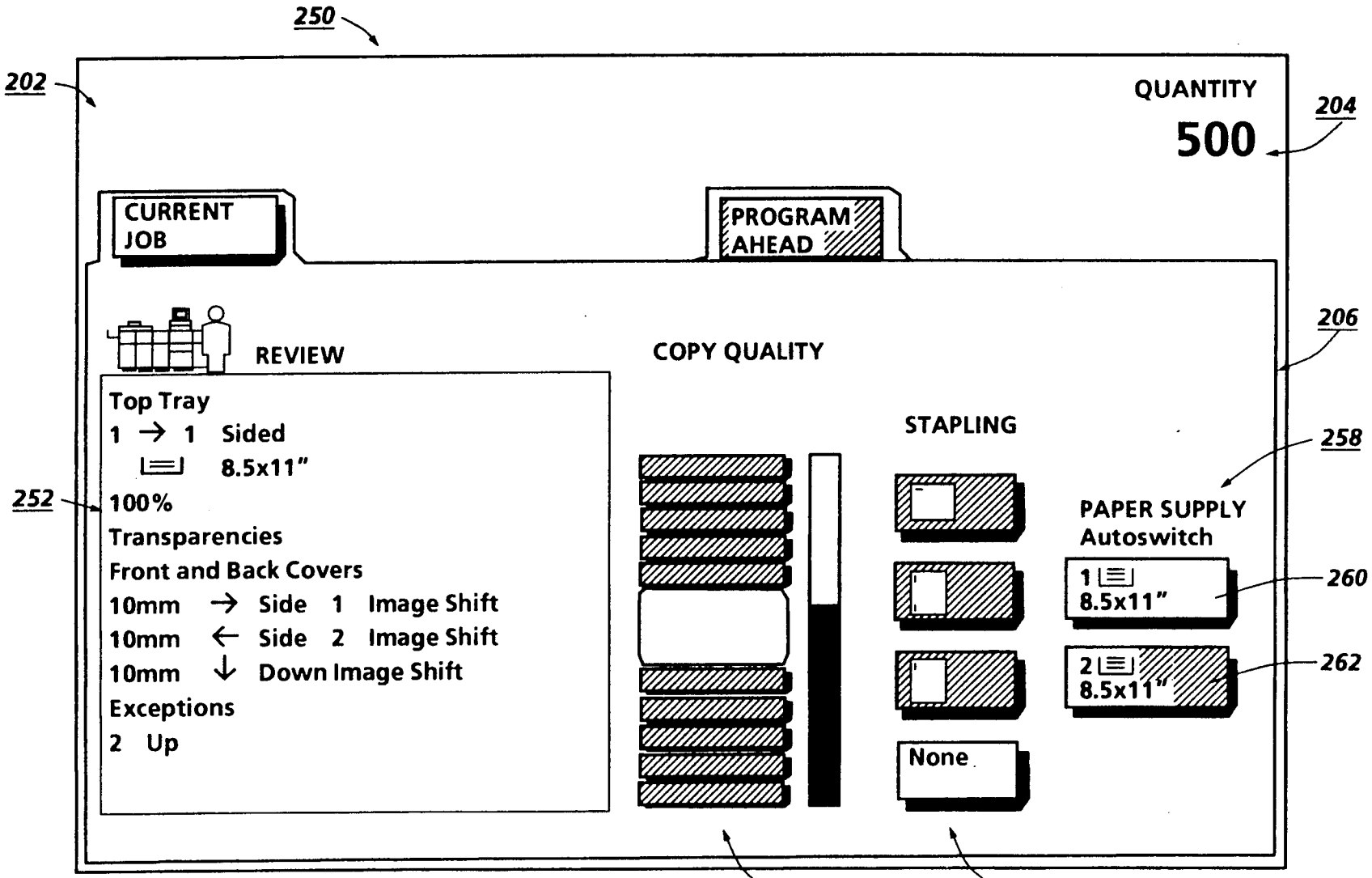
FIG. 6 is an illustration of a job status screen, in accordance with the present invention, as displayed on the user interface of FIG. 2.

Referring now to FIG. 6, which illustrates job status screen 250 as displayed on U/I 10, job status area 252 is used to display the current status of the copying job in progress. In addition, job status screen 250 displays certain user selectable icons that are suitable for dynamic alteration of the copying features during execution of the job. Specifically, copy quality selection area 254, stapling selection area 256, and paper supply selection area 258, are areas that display features that are dynamically alterable. Moreover, each of the selection areas, 254, 256, and 258 maintain the same function as their corresponding selection areas hereinbefore illustrated and described with respect to FIG. 3.

In accordance with the present invention, paper supply selection area 258, indicates the selection of the autoswitch feature, as previously programmed by the operator, using basic features programming screen 200 of FIG. 3. Also displayed in paper supply selection area 208 are paper tray icons 260 and 262, representing paper supply trays 1 and 2 respectively. Furthermore, paper tray icon 260 is shown in a highlighted condition, indicative of the fact that paper tray 1 is the currently selected paper supply tray and coinciding with the status indicated in the third line of job status area 252.

Figure 7:
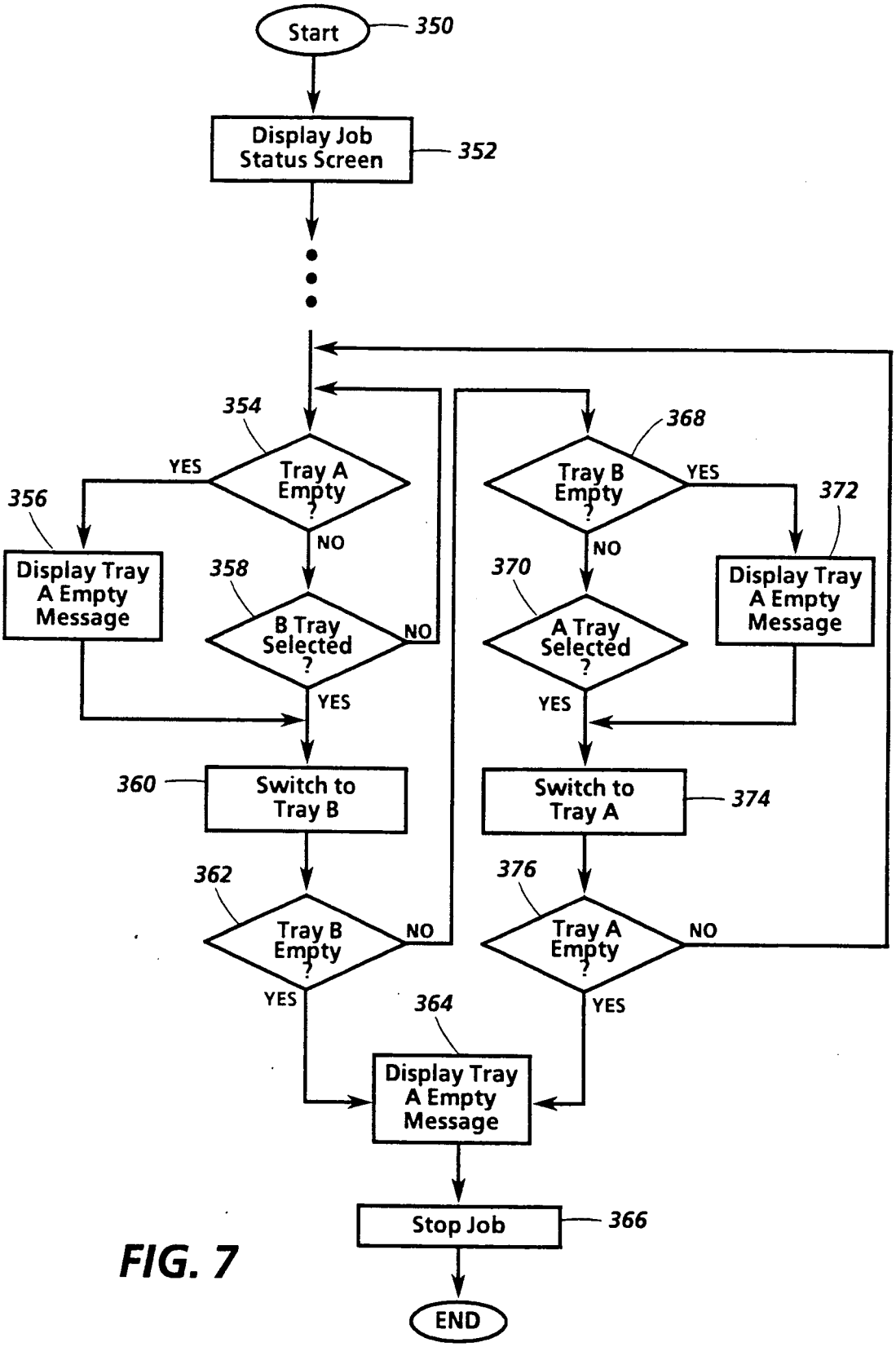
FIG. 7 is a flowchart of the procedure used to dynamically switch between paper supply trays during a copying job.

Referring also to FIG. 7, which is representative of the system operation with respect to the autoswitch feature, once an operator has initiated a copying job, block 350, job status screen 250 is displayed as indicated by block 352. In addition, paper supply selection area 258 includes paper tray icons representative of only those paper trays included in the set of alternate paper trays. The trays which are members of the alternate set being so identified by the system controller upon retrieving the previously described 3-bit autoswitch control value. During execution of the copying job, the system controller monitors paper sensors within currently selected tray A, represented by paper tray icon 260, to determine if paper is present in the tray, block 354. Should tray A be empty, a message will be displayed within message/status area 202 to indicate that the system had automatically switched from empty tray A to non-empty tray B, block 356. The system controller also monitors signals from the user interface to determine if the operator has selected alternate paper tray B, represented by paper tray icon 262. Should the system controller detect the operator selection of tray B, block 358, or alternatively detect that tray A is empty, block 354, tray B will become the currently selected paper supply tray, block 360. Next, the system controller tests the paper sensor associated with tray B to determine if paper is available in tray B, block 362. Should paper be available in Tray B, processing continues and the iconic representation of tray A icon 260, will return to a neutral display state and the tray B icon, icon 262, will be displayed in a highlighted fashion to distinguish it as the currently selected paper supply tray. Moreover, job status area 252 will be updated to indicate the change in the currently selected paper supply tray. If however, Tray B is empty, the system controller will cause the display of an empty tray message, block 364, within message/status area 202 to indicate to the operator that the tray is empty before stopping the copying job in block 366.

Assuming Tray B was not empty, the system controller now awaits signals indicative of a requirement to change from tray B back to tray A, blocks 368 and 370. In the same manner as the tray A to tray B switch occurred, the tray B to tray A switch will occur, displaying a tray B empty message, block 372, as appropriate, and subsequently switching the currently selected paper supply tray from tray B to tray A at block 374. As before, tray A is tested by the system controller, block 376, to determine if by tray A is empty. If so, the situation is handled in a manner identical to that earlier described in blocks 364 and 366. If not, cycling between the alternate paper trays, A and B, is then continued until a preselected quantity of copies have been produced. Cycling between alternate trays in this manner enables an operator to selectively switch from a high capacity paper tray, for example tray A, to a lower capacity tray, for example tray B, refill the high capacity tray and switch back again to the high capacity tray. Operation in this fashion would enable an operator to be away from the machine for an extended period of time during a large copying job. Moreover, giving the operator the ability to determine when he/she will refill the paper supply trays adds the flexibility necessary to improve operator efficiency.

It should be noted that the present invention, while described hereinbefore with respect to the selection of paper supply trays, is extensible to any feature setting that may be altered during the normal operation of a copying operation. The ability of the system controller to display, and therefore limit, those selections which are alterable during a copy run not only gives the operator maximum flexibility in controlling the machine operation, but eliminates the possibility of the operator disrupting the execution of the copy run.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. A reprographic system of the type having a set of features available for use in executing a copying job, including means for preselecting a subset of desired features from the set of all available features for the generation of the copies, a user interface suitable for displaying the available features as icons, the ability to execute the copying job in accordance with the preselected set of desired features and a job status screen, displayed on the user interface, indicating the system status during execution of the copying job, comprising:

means for displaying, on the user interface, a second subset of the available features, said second subset representing only those features whose settings may be altered during execution of the copying job without disruption;

means for altering the feature settings used in production of the copy output by selecting a feature setting from said second subset, whereby said feature setting will immediately become activated; and means for coincidentally deactivating the preselected feature setting corresponding to said feature setting selected from said second subset.

2. The system of claim 1, wherein the means for altering the feature settings used in production of the copy output further comprises:

means for detecting the need to alter the pre-selected feature setting; and means for automatically making the selection, from said second subset, of the appropriate feature setting.

3. An electrophotographic system of the type having copy sheets preloaded into a plurality of supply trays, copy sheet advancement means for removing successive copy sheets from the supply trays, copy sheet sensors to detect the presence of copy sheets in each of the supply trays, system control means for controlling the copy sheet advancement means in response to signals received from the copy sheet sensors, means for preprogramming the system control means to identify a set of alternate supply trays which may be utilized interchangeably by the system for the supply of copy sheets during a printing job, and means for selecting a first supply tray from the set of alternate supply trays as the currently selected supply tray, so that said currently selected supply tray will then be utilized to supply copy sheets at the beginning of the copying job, comprising:

means for indicating the selection of said first supply tray during the execution of the printing job;

means for displaying the set of alternate supply trays during the execution of the printing job; and means for selecting a second supply tray from the remaining trays within said set of alternate supply trays at any time during the execution of the printing job, so that said second tray will become the currently selected supply tray and said first supply tray will become a member of said set of alternate supply trays.

4. The system of claim 3, wherein the means for indicating the selection of said first supply tray comprises:

a video display screen; and an iconic representation of said first supply tray on said video display screen, whereby said first supply tray icon is displayed in a highlighted fashion, distinguishing it from any non-selected icons.

5. The system of claim 3, wherein the means for displaying the set of alternate supply trays comprises:

a video display screen; and an iconic representation on said video display screen for each of the supply trays within said set of alternate supply trays, whereby said nonselected alternate supply tray icons are displayed in a neutral fashion.

6. The system of claim 3, wherein the means for selecting a second supply tray comprises:

a video display screen;

a touch sensitive user interface capable of signaling the system control means and indicating the presence of a probe within specific coordinate regions of said user interface;

means for determining if said probe location is indicative of the selection of an alternate supply tray, said location determining means providing a signal to the system control means, so that the system control means will cause the copy sheet advancement means to stop feeding sheets from said first supply tray and to subsequently feed sheets from said second supply tray, wherein said second supply tray thereafter becomes known as the currently selected supply tray; and an iconic representation of said second supply tray on said video display screen, whereby said second supply tray icon is displayed in a highlighted fashion, thereby distinguishing it as the currently selected supply tray.

7. The system of claim 3, wherein the means for selecting a second supply tray comprises:

means, responsive to the copy sheet sensor of said first tray, for signaling when said first tray is empty; and means, responsive to said empty tray signal, for automatically selecting said second supply tray from the remaining trays within said set of alternate supply trays.

8. In an electrophotographic system of the type having copy sheets preloaded into a plurality of supply trays, copy sheet advancement means for removing successive copy sheets from each of the supply trays, copy sheet sensors to detect the presence of copy sheets in each of the supply trays, system control means for controlling the copy sheet advancement means in response to signals received from the copy sheet sensors, means for pre-programming the controlling means to identify a set of alternate supply trays which may be utilized interchangeably by the system for the supply of copy sheets during a printing job, and means for selecting a first supply tray from the set of alternate supply trays as the currently selected supply tray, so that said currently selected supply tray will then be utilized to supply copy sheets during execution of the job, the method of limiting the selection of alternate copy sheet supply trays, including the steps of:

indicating the selection of said first supply tray during the execution of the printing job;

displaying the set of alternate supply trays during the execution of the printing job;

limiting the selection of a second tray to a selection from said set of alternate supply trays;

upon detecting the selection of a second tray at any time during the execution of the printing job, causing said second tray to become said currently selected supply tray and enabling the feeding of subsequent copy sheets from said second tray; and returning said first tray to the set of alternate supply trays.

9. An electrophotographic system having a control means for controlling the operation of the system, a set of features available for use in executing a copying job, means for pre-selecting a first subset of desired features from the set of all available features to be included in the generation of the output copy sheets, a user interface suitable for displaying the features in representative iconic fashion and means for initiating the execution of the copying job in accordance with the preselected set of desired features, including:

means for indicating, on said user interface the current status of the copying job during its execution;

means for displaying on said user interface a second subset of the available features, whereby said second subset represents only those features whose settings may be altered during execution of the copying job, so as to alter the characteristics of the copying process, but that will not disrupt the execution of the copying job currently in progress; and means for enabling an operator to alter one or more features of said second subset during execution of the copying job.

10. The system of claim 9 including the means to inhibit the display of any feature that will conflict with the copying job in progress.

* * * * *